US008997645B1

(12) United States Patent
Cameron

(10) Patent No.: US 8,997,645 B1
(45) Date of Patent: Apr. 7, 2015

(54) PRINT PAD

(76) Inventor: Robert Cameron, Glenview, IL (US)

( * ) Notice: Subject to any disclaimer, the term of this patent is extended or adjusted under 35 U.S.C. 154(b) by 1853 days.

(21) Appl. No.: 11/823,784

(22) Filed: Jun. 28, 2007

Related U.S. Application Data

(60) Provisional application No. 60/831,715, filed on Jul. 18, 2006.

(51) Int. Cl.
*B41F 17/30* (2006.01)
*B41M 1/40* (2006.01)

(52) U.S. Cl.
CPC . *B41F 17/30* (2013.01); *B41M 1/40* (2013.01)

(58) Field of Classification Search
CPC ..... B41F 17/001; B41F 17/30; B41F 17/36; B41M 1/34; B41M 1/40
USPC ..... 101/41, 163, 35, 492
IPC ..... B41F 17/14, 17/16, 17/30, 17/34, 17/36
See application file for complete search history.

(56) References Cited

U.S. PATENT DOCUMENTS

| | | | | |
|---|---|---|---|---|
| 2,748,696 | A * | 6/1956 | Murray et al. | 101/41 |
| 4,889,421 | A | 12/1989 | Cohen | |
| 5,034,166 | A | 7/1991 | Rawlings | |
| 5,120,121 | A | 6/1992 | Rawlings | |
| 5,452,658 | A | 9/1995 | Shell | |
| 5,637,265 | A | 6/1997 | Misciagno | |
| 6,099,379 | A | 8/2000 | Eppley | |
| 6,196,683 | B1 | 3/2001 | Quinn | |
| 6,231,183 | B1 | 5/2001 | Dillon | |
| 6,470,797 | B1 * | 10/2002 | Holmberg | 101/41 |
| 6,979,419 | B2 | 12/2005 | Cameron | |
| 2008/0011177 | A1 * | 1/2008 | Muraoka | 101/492 |

* cited by examiner

*Primary Examiner* — Judy Nguyen
*Assistant Examiner* — Jennifer Simmons
(74) *Attorney, Agent, or Firm* — Law Office of John W. Harbst

(57) ABSTRACT

A print pad has a nearly spherical tip section having a first radius. A partially spherical first midsection is behind the tip section, the first midsection having a radius less that the radius of the tip section. A frustoconical second midsection is behind the first midsection. A bell shaped third midsection is behind the second midsection, and a frustoconical base is behind the third midsection.

4 Claims, 1 Drawing Sheet

PRINT PAD

The applicant claims priority from his provisional application filed Jul. 18, 2006 and assigned Ser. No. 60/831,715. The present application relates to a print pad for printing on concave surfaces such as a mold for making a contact lens.

BACKGROUND OF THE INVENTION

It has become common to print the design of the iris of an eye onto the surface of a contact lens so as to change the color of the eye of the user. One method of printing the design of an iris of an eye into a contact lens is to apply the print to the concave surface of a mold that is used to form the convex outer surface of the contact lens. When the polymer is subsequently applied to the mold and allowed to harden to form a lens, the contact lens will have the printing embedded into its convex surface. A print pad that is capable of printing such a design onto the convex surface of a mold for manufacturing a contact lens must be capable of deforming so as to contact the entire inner surface of the concave mold.

Existing print pads are made of a flexible polymer and have a spherical forward end. It has been found that the spherical forward end of existing pads will successfully apply print to the center of the concave mold, but cannot apply printing to the outer edges of the mold without causing distortion to the print applied to the center. Efforts to improve upon the spherical configuration of a print pad have resulted in print pads that do not linearly compress axially as force is applied to the concave mold, and therefore the pad does not print evenly around the outer circumference of the mold. Accordingly, there is a need for a print pad that can apply print evenly across the concave surface of a mold.

SUMMARY OF THE INVENTION

Briefly, the present invention is embodied in a polymer print pad attached to the forward end of a generally cylindrical plastic base for retaining the print pad to a printing machine. The body of the print pad has a nearly spherical tip section having an axial cross-section that defines an arc having a first radius that is longer than a radius that would define a spherical tip. Behind the tip section is a first midsection that diverges outwardly away from the rearward end of the tip section. The first midsection is also arcuate and when seen in axial cross-section defines an arc having a second radius that is less than the first radius. In the preferred embodiment, the second radius has an inner end that is coaxial with the longitudinal axis of the print pad.

Rearwardly of the first midsection is a frustoconical second midsection that continues to diverge radially outwardly and rearwardly from the first midsection. Behind the second midsection is a third midsection that flares radially outwardly of the second midsection and defines a fillet.

Finally, behind the third midsection is a frustoconical base where the base diverges rearwardly and outwardly of the outer circumference of the third midsection, with the bottom of the base mounted to a forward surface of a cylindrical plastic retainer.

BRIEF DESCRIPTION OF THE DRAWINGS

A better understanding of the present invention will be had after a reading of the following detailed description taken in conjunction with the drawings wherein.

DETAILED DESCRIPTION OF THE INVENTION

Figure 1:
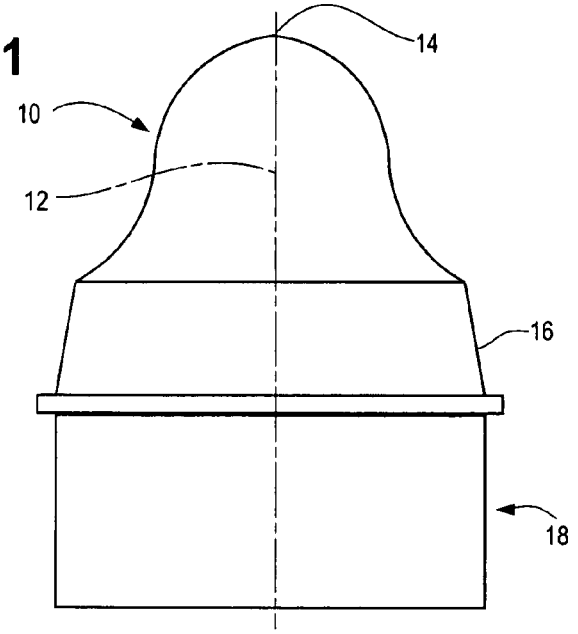
FIG. 1 is a side elevational view of a print pad in accordance with the present invention mounted to a base.

Referring to FIG. 1, a print pad 10 for printing on the concave surface of a mold needed to manufacture a contact lens is made of a flexible polymer and is symmetric around its longitudinal axis 12 and has a forward end 14 and a rearward end 16. The rearward end 16 of the print pad 10 is molded to the forward surface of a generally cylindrical plastic retaining base 18.

In order to provide a contour that will apply printing to the entire concave surface of a mold for making a contact lens, the print pad 10 must have a highly polished outer surface and a configuration that will deform and apply print across the concave surface of the mold without causing smearing or uneven application. The print pad 10 must also axially deflect without diverging from side to side as the print pad is applied to the mod.

Figure 2:
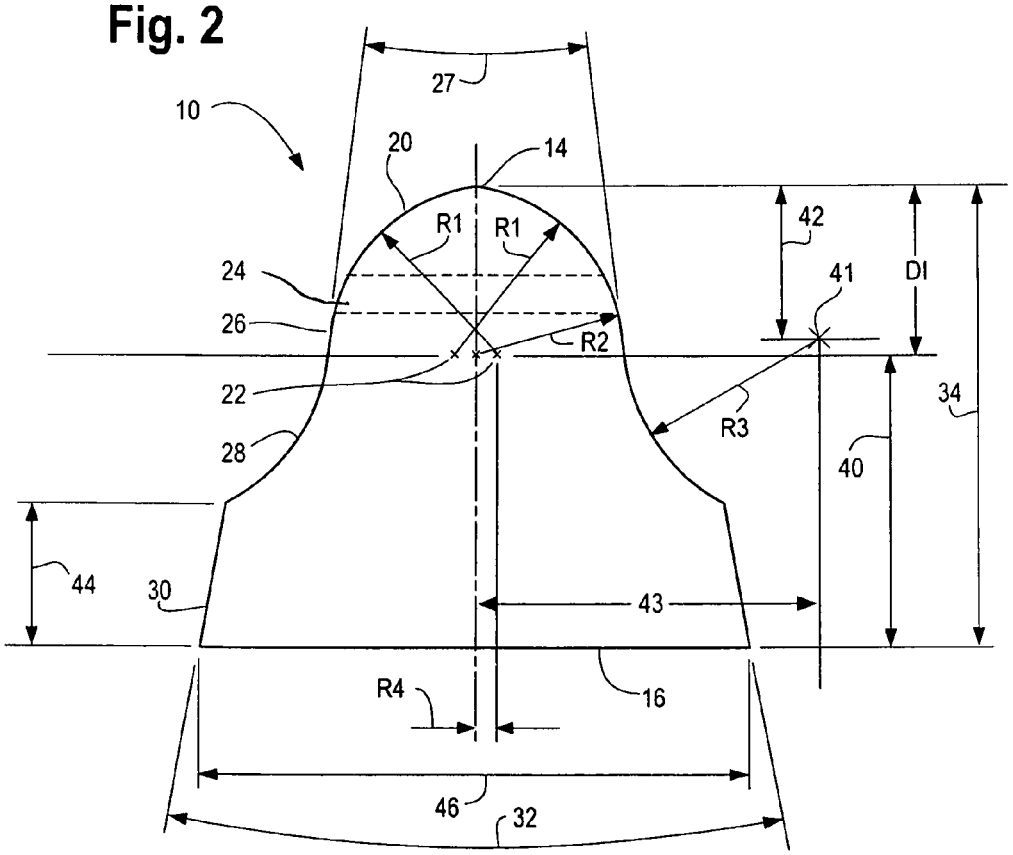
FIG. 2 is a cross-sectional view of the print pad shown in FIG. 1.

Referring to FIG. 2, a print pad 10 suitable for printing on a concave surface of a mold has a tip section 20 that is nearly hemispherical, but differs from a hemisphere in that the arcs that conform the tip section have a radius R1 that has an inner end 22 that is radially inward of the longitudinal axis 12, such that the outer surface converges to a gentle peak at the forwardmost end 14 of the tip section 20. Positioned behind the tip section 20 is a first midsection 24. When seen in cross-section, the first midsection 24 has a base radius R2 that is less than the radius R1 and the inner end of the radius R2 is positioned on the longitudinal axis 12. The first midsection 24 continues to diverge outwardly from the tip section 20 to a forward end of a second midsection 26. The second midsection 26 is frustoconical with a surface having an inclusive angle of divergence 27 of fourteen degrees.

Rearward of the second midsection 26 is an outwardly flaring, or bell shaped third midsection 28 forming a fillet having an arc having a radius R3 when seen in axial cross-section. Rearwardly of the third midsection 28 is a frustoconical base section 30 that diverges from the rearward end of the third midsection 28 to a larger diameter at the rearward end 16 of the print pad 10. The frustoconical base section 30 diverges with an inclusive angle 32 of twenty degrees.

Figure 3:
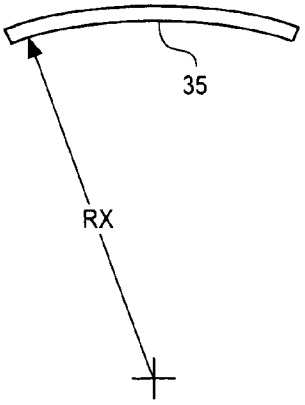
FIG. 3 is a cross-sectional view of a concave surface for receiving a printing from the print pad shown in FIGS. 1 and 2.

As shown in FIG. 3, to print on a concave surface 35 defining a sphere having a radius RX of about 7 millimeters, the first radius R1 is approximately 6.276 millimeters, the second radius R2 is approximately 5.537 millimeters and the third radius R3 is approximately 7.493 millimeters. The pad 10 has an overall height 34 extending from the forward end 14 to the rearward 16 of approximately 17.15008 millimeters. The first radius R1 has an inner end 22 positioned a radial distance R4 of approximately 0.82804 millimeters and a distance 40 from the rearward end 16 of approximately 11.85678 millimeters. The inner end of the second radius R2 is positioned on the longitudinal axis 12 at a distance D1 that is approximately 5.2933 millimeters from the forward end 14. The third radius R3, when seen in axial cross-section, has a beginning point 41 that is a distance 42 of approximately 5.2933 millimeters from the forward end 14 and a radial distance 43 that is approximately 10.16 millimeters outward of the longitudinal axis 12. Finally, the base section 30 has an overall width 44 of approximately 5.40512 millimeters and the base has a maximum width 46 of approximately 20.32 millimeters. To print on a concave spherical surface having a radius RX that is greater than 7 millimeters or less than 7 millimeters, the various dimensions are increased or decreased proportionately to the dimensions ste forth above, The ratio being:

$$RX/7=R1/6.276=D1/5.2933=R2/5.537=R4/0.82804.$$

Print pad 10 as described above will deflect uniformly when the forward end 14 is against the center of a concave mold and pressure is applied to the print pad 10 along the longitudinal axis 12.

While the present invention has been described with respect to a single embodiment, it will be appreciated that there are modifications and variations that can be made without departing from the spirit and scope of the invention. It is therefore the intent of the appended claims to cover all such modifications and variations that fall within the spirit and scope of the invention.

What is claimed is:

1. A print pad for printing on a concave surface, with said print pad defining a longitudinal axis, comprising;

a longitudinally extended tip section that in axial cross-section defines a pair of complementary converging arcs, with both of said arcs having a first radius R1 that is longer than a distance D1 an inner end of the complementary arcs is spaced from a peak of the printing pad toward which said complementary arcs converge, and with an inner end of the complementary converging arcs being a distance R4 from the longitudinal axis of said print pad, a first midsection behind said tip section, said first midsection diverging outward and away from said tip section and in axial cross-section defining an arc having a second radius R2 less than said first radius R1, with an inner end of the second radius R2 being disposed adjacent to the longitudinal axis of said pad, a frustoconical second midsection behind said first midsection, a third midsection behind said second midsection, said third midsection flaring radially outward of said second midsection and defining a fillet, a frustoconical base behind said third midsection, said frustoconical base diverging rearwardly from an outer circumference of said third midsection, and said tip section, said first, second and third midsections and said base all being symmetrical about the longitudinal axis of said pad.

2. A print pad for printing on a concave surface, comprising:

a longitudinally extended nearly spherical tip section that in axial cross-section defines an arc having a first radius R1 that is approximately 6.276 millimeters, with the base of the radius R1 being a distance R4 of approximately 0.82804 millimeters from a longitudinal axis of said print pad and a distance D1 from a tip thereof of approximately 5.2933 millimeters, a first midsection behind said tip section, said first midsection diverging radially outward and away from said tip section and in axial cross-section defining an arc having a second radius R2 of approximately 5.537 millimeters and with the base of radius R2 being radially offset from said longitudinal axis and a distance D1 from said tip thereof of approximately 5.2933 millimeters, a frustoconical second midsection behind said first midsection, said frustoconical second midsection having an inclusive angle of approximately 14 degrees, a third midsection behind said second midsection, said third midsection flaring radially outward of said second midsection and defining a fillet, a frustoconical base behind said third midsection, said frustoconical base diverging rearwardly from an outer circumference of said third midsection.

3. A print pad for printing on a concave surface, comprising:

a longitudinally extended tip section that in axial cross-section defines a pair of converging complementary arcs with both of said arcs having a first radius R1 that is longer than a distance D1 an inner end of the complementary arcs is spaced from a peak of the printing pad toward which said complementary arcs converge, and with an inner end of the complementary arcs being a distance R4 from a longitudinal axis of said print pad, a first midsection behind said tip section, said first midsection diverging radially outward and away from said tip section, with an axial cross-section of said first midsection defining an arc having a radius whose inner end is disposed adjacent to a longitudinal axis of said pad, a frustoconical second midsection behind said first midsection, another midsection flaring radially outward of said second midsection and defining a fillet, a base behind said second midsection, said base diverging from an outer circumference of said another midsection, and said tip section, said first and second midsections, said another midsection and said base all being symmetrical about the longitudinal axis of said pad.

4. A print pad for printing on a concave surface that defines a sphere having a radius RX, said print pad comprising:

a longitudinally extended nearly spherical tip section that in axial cross-section defines an arc having a first radius R1 with the base of the radius R1 being a distance R4 from a longitudinal axis of said print pad and a distance D1 from a tip thereof of approximately 5.2933 millimeters, a first midsection behind said tip section, said first midsection diverging radially outward and away from said tip section and in axial cross-section defining an arc having a second radius R2 of approximately 5.537 millimeters and with the base of radius R2 being on said longitudinal axis and a distance D1 from said tip thereof, a frustoconical second midsection behind said first midsection, said frustoconical second midsection having an inclusive angle of approximately 14 degrees, a third midsection behind said second midsection, said third midsection flaring radially outward of said second midsection and defining a fillet, a frustoconical base behind said third midsection, said frustoconical base diverging rearwardly from an outer circumference of said third midsection, wherein said dimensions R1, R2, R4, D1 are in millimeters and found by the equation RX/7=R1/6.276=D1/5.2933=R2/5.537=R4/0.82804.

* * * * *